United States Patent [19]

Erber

[11] Patent Number: 4,715,421

[45] Date of Patent: Dec. 29, 1987

[54] ROLLER SHUTTER WITH JALOUSIE-TYPE LOUVERS

[76] Inventor: Günther Erber, Völkermarkterstr. 355, A-9020 Klagenfurt, Austria

[21] Appl. No.: 734,398

[22] Filed: May 15, 1985

[30] Foreign Application Priority Data

Oct. 25, 1984 [EP] European Pat. Off. ..... 84890199.7

[51] Int. Cl.[4] ..... E06B 9/08

[52] U.S. Cl. ..... 160/133; 160/176 R

[58] Field of Search ..... 160/133, 169, 170, 174, 160/176 R, 34, 35, 36, 235, 236; 49/82, 74

[56] References Cited

U.S. PATENT DOCUMENTS

| | | | |
|---|---|---|---|
| 1,830,487 | 11/1931 | Samberg | 160/176 |
| 2,912,048 | 11/1959 | Grau | 160/133 |
| 3,412,506 | 11/1968 | Shiota | 49/82 |
| 4,013,113 | 3/1977 | Frei | 160/35 |
| 4,119,133 | 10/1978 | Wolf | 160/201 |
| 4,320,793 | 3/1982 | Lindbergh | 160/201 |
| 4,379,479 | 2/1983 | Whiting | 160/201 |
| 4,573,512 | 3/1986 | Lichy | 160/133 |

FOREIGN PATENT DOCUMENTS

| | | | |
|---|---|---|---|
| 1055796 | 4/1959 | Fed. Rep. of Germany . | |
| 1260113 | 2/1968 | Fed. Rep. of Germany . | |
| 1266475 | 4/1968 | Fed. Rep. of Germany . | |
| 1683643 | 12/1970 | Fed. Rep. of Germany . | |
| 2834268 | 2/1980 | Fed. Rep. of Germany . | |
| 1453982 | 8/1966 | France | 160/133 |
| 653463 | 5/1951 | United Kingdom | 160/201 |

*Primary Examiner*—Ramon O. Ramirez
*Assistant Examiner*—Blair M. Johnson
*Attorney, Agent, or Firm*—Karl F. Ross; Herbert Dubno

[57] ABSTRACT

A roller shutter has louvers which are pivotal about respective axes between their opening and closing positions by movement of respective chains parallel to the axes of pivot pins upon which the louvers are journaled and which interconnect links of the chain. Screw formations between the pivot pins and the links translate the linear displacement of the links into pivotal movement of the louvers. The adjoining edges of adjacent louvers can hook together.

16 Claims, 11 Drawing Figures

ROLLER SHUTTER WITH JALOUSIE-TYPE LOUVERS

FIELD OF THE INVENTION

My present invention relates to a roller shutter having jalousie-type louvers, i.e. louvers which in the unrolled position in the shutter can be pivotal from closed to open orientations and visa versa.

BACKGROUND OF THE INVENTION

Roller shutters are described, inter alia, in German patent document - printed application DE-AS No. 12 66 475 and DE-AS No. 10 55 796 and comprise chains along at least one edge of the array of louvers which serve to adjust the orientation of the louvers between the open and closed positions.

In jalousies, moreover, the louvers are pivotal about fixed axes and can be actuated by means of meshing gears (see German patent document - open application DE-OS No. 16 83 643). It is even known to provide jalousie louvers for the rear window of automobiles and other vehicles in which the louvers are swingable about fixed axes in a frame and the orientations of the louvers can be adjusted to suit the requiremeuts for the vehicle and, where the jalousie arrangement is mass produced, can be accommodated to vehicles of different types and sizes. This, of course, allows the inclination of the louver to be set for rear windows of different inclinations, etc.

OBJECTS OF THE INVENTION

It is the principal object of the present invention to provide improved means for controlling the tilt of jalousie-type louvers, especially on roller shutters and the like.

Another object of my invention is to provide an improved roller shutter in which the tilt of the louvers can be more effectively controlled.

Still another object of the invention is to provide relatively simple, functionally reliable and mechanically stable controls for the tilt of the louvers, especially for a roller shutter.

SUMMARY OF THE INVENTION

These objects and others which will become apparent hereinafter are attained, in accordance with the invention, in a roller shutter or, more generally, a shutter in which a multiplicity of louvers can be swung about respective axes between closed and open positions, wherein one or both of the chains flanking the array of louvers is provided with means for displacing a respective screw formation relative to a screw formation provided on a pin projecting from each louver in an axial direction of that pin whereby the relative axial movement of the screw formation induces an angular displacement of the respective louver about its pivot axis.

The term "screw formation" is utilized to represent any generally helical actuating structure on at least one of two relatively movable and interengageable parts such that the axial linear movement by the translation will bring about an angular displacement of that part which is angularly coupled to the respective louver.

More specifically, the invention is applicable to roller shutters in which the louvers are carried by a pair of chains so that the shutter can be rolled up about an axis parallel to the individual axes of the louvers. Furthermore, one or both chains can be displaceable in the axial direction, i.e. in a direction perpendicular to the longitudinal dimension of the respective chain.

Each of the louvers can have a pair of journaling pins projecting from the opposite ends of the louver and defining the respective individual louver pivot axis and at least one, but preferably both of the chains, can pivotally carry these pins and can be axially movable therealong. The pin journals and/or the pins themselves can form the interengageable members provided with the screw formations or surfaces or at least one such formation or surface cooperating with a counter surface of the other member so that the shifting of a respective chain axial along the pins causes an interaction of the screw surface and the counter surface so as to rotate the louver as a result of this axial displacement.

With the special configuration of the pins and the journal portions of the chain set forth above, the change in the angular position of each louver is effected by a simple shifting of the chain in the axial direction of the louver pins.

The screw surface can be a helical ridge or rib but may also be a groove in the journaling pin or in the pin journal with the other of these members having a slidable formation or projection engageable in the groove.

The entire actuating structure can be provided in guide profile located in the opening into which the shutter is to be extended and can include a rail which engages the chain and can shift the latter in the axial direction of the pins. As a consequence, the invention is applicable not only to new shutters built in accordance with the principles of this invention, but even to shutters which are already in place.

In accordance with the invention, therefore, the chain can be guided in this rail during the extension of the roller shutter and the rail can be shiftable laterally of the shutter within the profile or frame member provided in the room opening in the direction of the axes of the aforementioned pins.

While the term "pins" has been used herein, it should be understood that this term will also include projecting ends of a continuous shaft extending across the entire opening and through or along the respective louver.

It has been found to be advantageous to provide the actuating rail with pins which project into inclined slots of a profile member receiving the rail, the inclined slots being parallel to one another and adapted to cam the rail laterally, i.e. with an opening of movement in the direction of the axes of the pins when the rail is displaced in its longitudinal direction.

Alternatively, the profile member can be provided with the pins and such slots can be formed in the rail.

Furthermore, slots can be provided with extensions which are parallel to the direction of displacement of the rail and the longitudinal direction thereof into which the pins can engage after they have traversed the inclined portions of the slots so that the rail can then be locked against further displacement and hence the louvers prevented from rotating once they have been so locked in place by manual action upon the louvers themselves.

To actuate the rail by displacing it parallel to its longitudinal direction, various elements can be used analogous to those used for raising and lowering the roller shutter.

To ensure that the louvers are in their closed orientations when the roller shutter is raised, I can provide in accordance with a further feature of the invention, that at the mouth of the roller shutter housing an inclined ramp is provided which can engage an inclined camming surface upon raising of the shutter, the cooperating inclined surface and ramp being parallel to the aforementioned slots.

It has been found to be advantageous, moreover, to interconnect the louvers over the widths thereof in the closed position of the louvers so that an opening of the closed shutter structure from the outside, for example, is precluded or at least made more difficult even when the louvers are composed of an easily bendable or comparatively fragile or weak material.

The interengagement means can be designed so that the louvers in the closed position latched together substantially automatically.

In accordance with the invention this is achieved by providing the louvers so that they are mounted for translatory movement relative to the chain in their longitudinal directions and have along their longitudinal edges wall segments which cooperate with wall segments of adjoining louvers so that an interfitting can occur at least over part of the lengths of the louvers. In other words, in the interfitted parts within the wall sections overlap and indeed can hook together as a result of the translatory movement of the louvers.

Alternate louvers may move in opposite directions under the control of the respective chains which can be displaceable in the direction of the respective pin axes.

The interengagement of the overlap portions of the louvers, therefore, assist in preventing breakin through the shutter. To facilitate this displacement parallel to the respective pivot axes, the aforementioned pins are provided adjacent the respective screw surfaces with a section having no screw surface so that a translatory movement can be generated without simultaneous generation of an angular displacement.

When the screw surface is a helical groove in which projection or slide of the journal is engaged, this slide can then ride in a rectilinear extension of the groove to permit following the angular displacement of the louver and axial displacement thereof in the translatory sense mentioned previously.

According to another feature of the invention, each of the louvers is formed on its lower edge with a continuous apron spaced forwardly of the lower wall section and adapted to cover the intervening space between louvers. In the space between the lower wall section and the apron, the upper wall section of the adjoining louver can be received and can be shifted in this space axially. With this configuration in the closed condition of the shutter practically all gaps between neighboring louvers are blocked so that structural details of the shutter cannot be ascertained from the exterior.

In order to ensure formfitting connection of neighboring or adjoining louvers in the roller shutter of the invention, I can provide the longitudinal edge of a wall portion of one of the louvers with hooklike offset portions which engage in hooklike offset portions of neighboring louvers.

To permit some airflow through the shutter in its closed position and thus allow some ventilation of the space which is closed by the roller shutter, while nevertheless preventing undesired opening, mutually adjacent elements of the chains, i.e. the link members thereof can be coupled by a pin-and-slot connection so that the slots extend substantially in the longitudinal direction of the link elements when the latter are upright and the shutter has been lowered, while slots define a displacement stroke between neighboring louvers which is preferably greater or at least equal to the distance between the root of the hooklike formation of one louver and the free edge of the corresponding hooklike formation of the neighboring louver so that these two parts will seat together if a louver is lifted.

In this case, when the shutter is raised, relative pivotal movement of the louvers is possible whereas when the shutter is fully lowered and the louvers are in their closed positions, a form locking connection between adjacent louvers is ensured.

To permit the translatory movement of adjoining louvers with respect to one another, according to a particularly effective construction of the present invention, each louver in the region of its journaling pins is provided with a pair of bosses, projections or steps extending in the longitudinal dimension of the louver, preferably in the form of a sleeve or boss surrounding the journaling pin. The two projections of each louver have, however, different lengths and are so arranged in the roller shutter of the invention that shorter projections alternate with longer projections along each edge of the shutter and each chain.

When each chain is thus displaced toward the other chain in the axial direction of the pins, therefore, the chains on the two sides of the shutter engage the respective longer projections on that side and thereby entrain only those louvers in the translatory direction. The short projections move toward these chains by reason of the engagement of the longer projection on the offset side of such louver by the opposing chain.

This arrangement provides simple means for effecting the translatory movement as well as for limiting such translatory movement.

According to yet another feature of the invention, the ends of the pins of the louvers are braced against rails or bars disposed on opposite sides of the roller shutter, preferably spring-loaded rails, the springs tending to bias the two bars toward one another and thus automatically return the louvers when the chains are moved apart.

To actuate the shifting rail so as to swing the louvers, the weight of the roller shutter shield or protective unit can be utilized, for example, during the last part of the shutter-closing or lowering movement. The last of the louvers to be brought into place upon lowering the shutter, i.e. the uppermost louver can be provided with latching means which operatively engages the shifting rail, i.e. so-called entrainers, so as to displace the shifting rail in its longitudinal direction and thereby swing the shutter louvers open.

Similarly entrainers cooperating with the shifting rail can be used to displace the shifting rails in the offset directions with incipient lifting movement of the shutter to swing the louvers into their closed positions.

Naturally, the same shifting rails can effect the translatory motion of the louvers which has been described above.

An entrainer in the form of a fork can be provided and can receive between its tines an entrainment pin or the like which is fixed on the shifting rail.

The entrainer can be swingable about an axis perpendicular to the shutter plane in the closure rail. This arrangement ensures reliable coupling of the entrainer with the entrainer pin on the shifting rail as well as a decoupling by reason of the roller shutter.

In an especially advantageous construction according to the invention, the entrainer has a toothlike projection which is movable between two detents on a leaf spring-like structure in the closure rail. The detents releasably retain the entrainer in each of its operating positions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 1A:
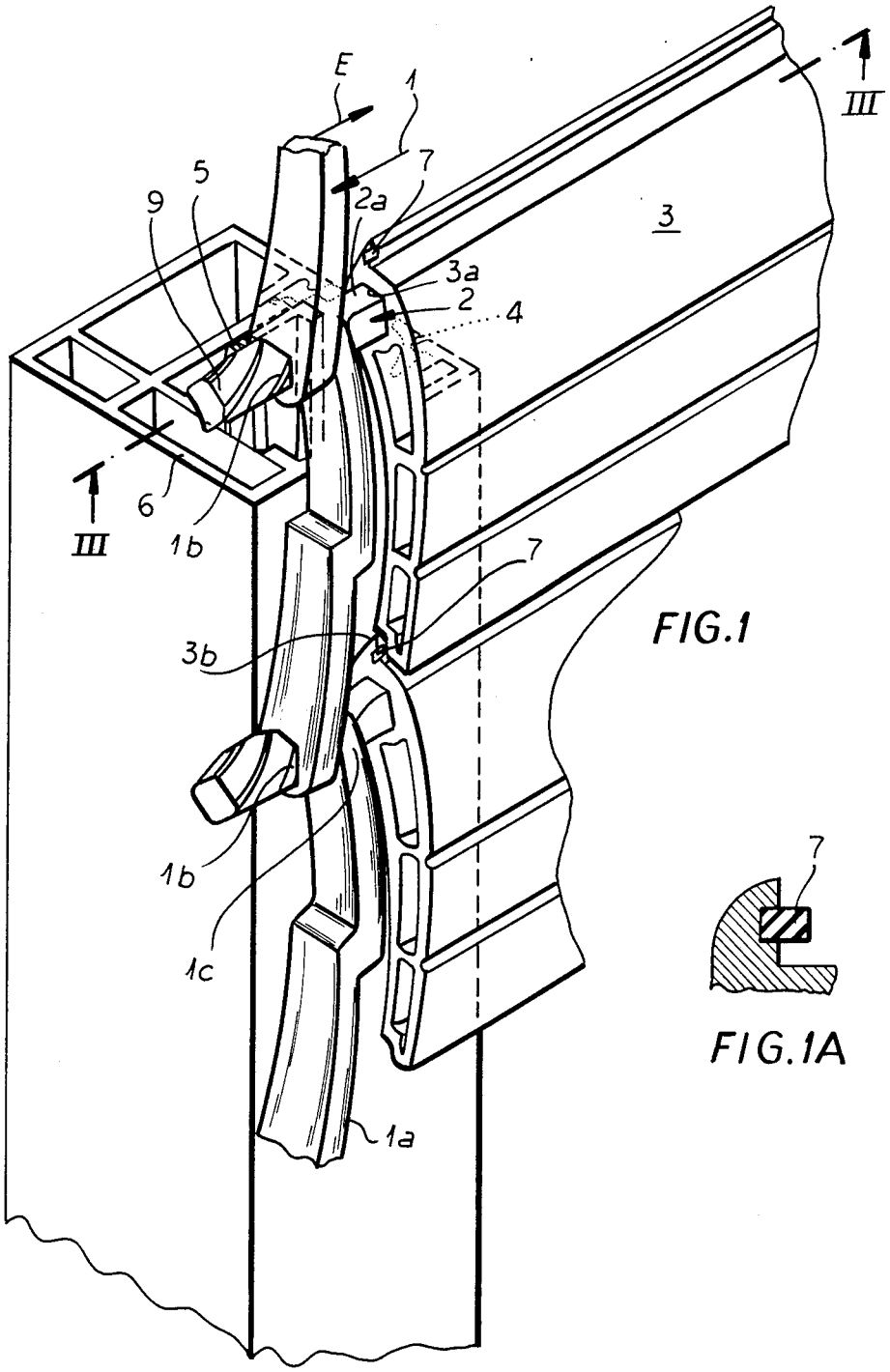
FIG. 1 is a fragmentary perspective view in highly diagrammatic form showing a shutter in accordance with the invention in which the louvers are in their closed positions.
FIG. 1*a* shows a cut-away section of the top edge of a shutter.
Figure 3:
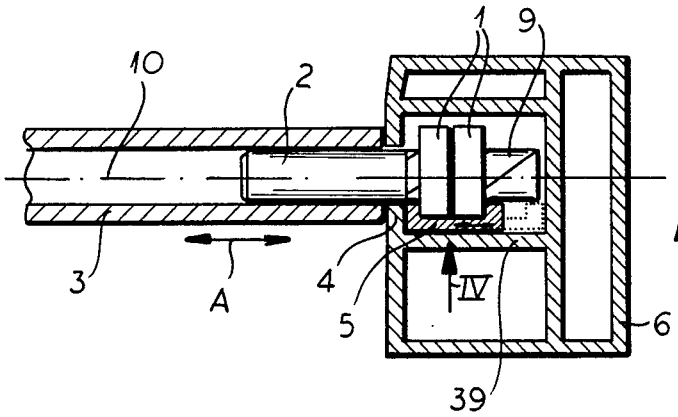
FIG. 3 is a section along the line III—III of FIG. 1 but reversed.

In the drawing, the louvers of a swingable-louver or jalousie-type shutter have been represented at 3, each of these louvers 3 having a pair of journaling pins 2 which project in opposite directions from the end surfaces of the louvers and which are engaged by a chain 1 disposed along each side of the array of louvers.

In the embodiment shown in FIGS. 1–4, the pivot axis of each of the louvers is locked along the upper edge of each louver. Naturally the pivot axis can also lie in the center of a louver, in which case the journaling pins 2 will likewise lie along the axis of the center of the louvers.

The journaling pins 2 can be formed by opposite ends of a shaft which is keyed to the louver and can extend the full length thereof (FIG. 5) or by respective shaft stubs (FIG. 3) which can be keyed to the louvers. As will be apparent from FIG. 1, the interconnection for joint rotation or keying is effected in the embodiment of FIGS. 1–4 by providing the shaft stubs or pins 2 with square shanks 2*a* which are received within square-section passages 3*a* of the louvers 3. The pins 2 can be forcefitted into the louvers or the louvers 3 can be molded onto these pins so that in either case, the pins are fixed to the respective louvers.

As will be apparent hereinafter, the chain 1 is shiftable in a direction transverse to itself, i.e. in the axial direction of the pins engaged thereby, this axial displacement serving to pivot the louvers. Advantageously the opposite chain (not seen in FIG. 1, but mirror-symmetrical to the chain which has been shown), is likewise displaceable in the opposite direction in engagement with its pins.

Each of the journaling pins 2 in the embodiment of FIGS. 1–4 is provided with a screw formation 9 on its periphery. In the embodiment shown the formation is a multiple-ridge screw thread with an extremely shallow pitch, the screw thread 9 being engagaged in a mating screw-thread formation of the links or bars 1*a* forming the chain 1. The female formations have been represented at 1*b* in FIG. 1.

While the relative axial movement is thus effected between mating screw-thread formations of the chain and the pin or shaft member to effect the pivoting acting of the invention, it should be understood that other means may accomplish a similar effect. For example, the chain may axially shift the respective pins relative to the louvers and/or to a separate journal member for each pin. In that case, the journaling member and the pin member would be provided with the mating helical or screw formations. Alternatively, as has been indicated in the embodiment illustrated, the journal member may be formed by the chain so that the chain and the pin members are provided with the mating screw or helical formations.

In any event a displacement of the chain in the direction of the axes of the pins 2, move the journal members axially without rotation relative to the pin members and because of the interengagement of the threaded formations, rotates the pin members to swing the louvers about the axis of rotation thereof defined by the common axis of the pins of each louver. In the embodiment illustrated, this axis has been shown at 10.

Consequently, in the embodiment illustrated in FIGS. 1–4, the pivot pins 2 of the louvers 3 simultaneously form connecting pins for the members 1*a* of the chain 1. One of the interconnected ends, for example, the end 1*c* (FIG. 1) of each member can be formed with a cylindrical bore within which the pin can simply rotate while the other end of a member 1*a* interconnected by that pin can be provided with the female screw-thread formation as represented at 1*b*.

The screw-thread formation 9 may be a twist formed in a rectangular-cross section shaft as shown or a hexagonal section shaft, if desired.

Naturally, other helical or equivalent screw-thread formations may be used. For example, the helical formation in the shaft or pin can be constituted as a groove in which a slide block of the pin-receiving bearing member of the chain can be received. The pitch of the groove or screw thread preferably should be between 30° and 45°.

The upper longitudinal edge of each louver 3 can be formed with a rib 7 of sealing material in a corresponding longitudinal groove of the louver and which can abut a corresponding abutment or rib on the lower longitudinal edge of the adjacent louver 3 in the closed position of the louvers. In the embodiment illustrated in FIG. 1, the sealing material 7 lies in a stepped recess 3*b* of the louver 3. Consequently, in the closed condition of the shutter (FIG. 1) the latter provides a tight seal.

To enable the chain 1 to be shifted in a simple manner along the axes 10 of the pins 2, a shifting rail 5 is provided which can be received in a frame member 6 disposed along each side of the shutter, these profiled members which can be aluminum or plastic extrusions being interconnected into a frame structure in which the shutter is mounted and which has not otherwise been illustrated.

The displacing rail engages the links of the chain (see, for example FIG. 3) and can in turn be shifted in the direction of the arrow A, for example, by a screw mechanism or any other actuator, e.g. a crank mechanism, to effect the axial displacement of the chain. The displacement of the rail 5 within the frame member 6 has been shown diagrammatically in FIG. 4. In the broken line illustration in this Figure, the louvers 3 are fully opened, i.e. swung outwardly into the position shown in FIG. 2, whereas in the solid line position of the rail 5 of FIG. 4, the louvers 3 are tightly closed (FIG. 1).

To guide the rails 5 within the frame members 6, pins 11 are provided on these rails and engage in inclined slots 12 formed in walls 39 of the profile members 6. Consequently, the back and forth displacement of the rail 5 can be effected by moving the rail in its longitudinal direction, i.e. the direction illustrated by the arrow C in FIG. 4.

Figure 7:
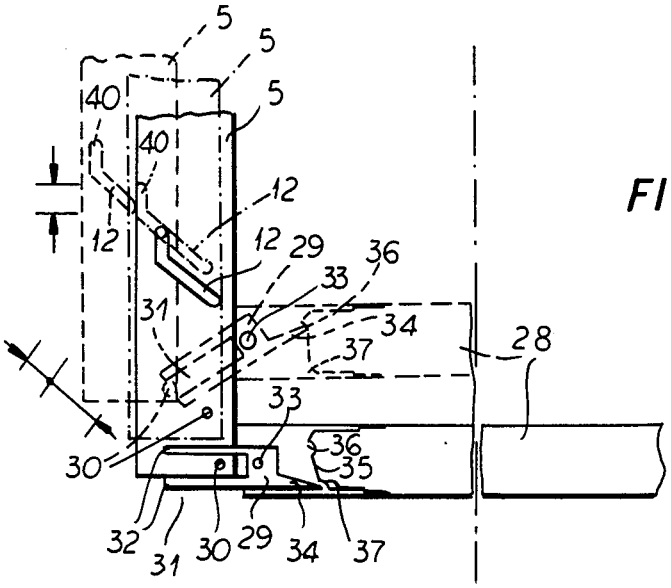
FIG. 7 is a detail elevation of a lower end of a rail illustrating the operation of a shutter according to the invention.

The inclined slots 12 can have extensions 40 communicating therewith as illustrated in FIG. 7, these extensions running parallel to the longitudinal dimension of the respective rail and being adapted to receive the respective pins 11 to secure the rails 5 in the direction of the axes 10 of the louvers in at least one direction to ensure thereby a lock of the louvers in their closed position against forces applied to the louvers from the exterior. In other words I can thereby lock the louvers in their closed position so that someone attempting to open the louvers by swinging them upwardly about their respective axes 10 will be unable to do so without any independent actuation of the rails 5. As FIG. 4 also shows, in the region at which the louvers 3 open into the shutter housing 13, the rail 5 is provided with a guide formation 14 which is inclined to the lifting direction of the louvers and which cooperates with the links of the chain 1.

The shutter housing 13 has a stationary ramp 38 for the links of the chain 1.

Figure 4:
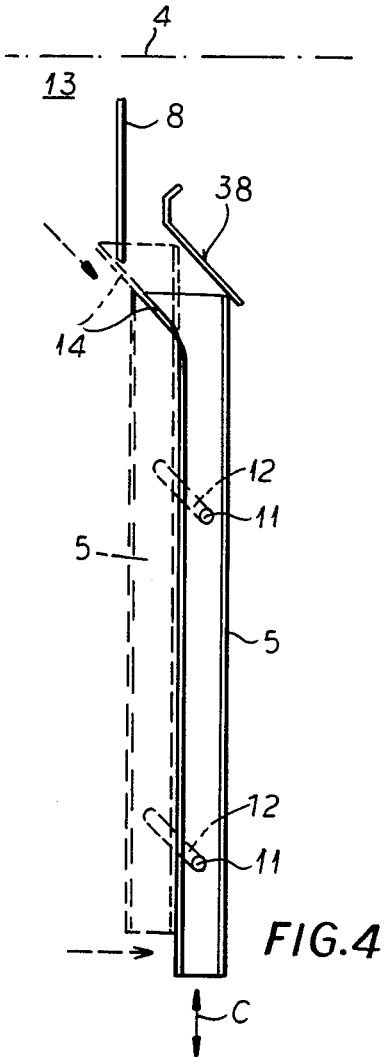
FIG. 4 is a view in the direction of the arrow IV of FIG. 3 but in much more schematic form and in which parts not required for understanding of this FIGURE have been omitted.

In FIG. 4 the axis about which the shutter can be coiled up in the shutter housing 13 has been represented at 4 whereas the disk along which the chain 1 is laterally guided upon rolling up the shutter has been represented at 8. The guide 14 and the ramp 38 run parallel to the slots 12 engaged by the pins 11 of the rail 5.

It is also possible, however, to provide an arrangement in which the pins 11 are fixed in the wall 39 of the profile 6 while the slots 12 are provided in the manner shown upon the displacement rail 5.

The disk 8 extends in the region of the profile 6 substantially to the guide 14 of the displacement rail 5 (FIG. 4). The guide 12 and the ramp 38 on the intake side of the roller shutter housing, which has not been illustrated to any significant extent, cooperate and serve to displace the rail 5 and thereby move the louvers from their open positions into their closed positions for windup of the shutter. The roller shutter housing has only been shown diagrammatically by the numeral 13 and of course is intended to receive the louvers only after they have been swung into their closed position.

Upon rolling up of the shutter, the ramp 38 engages the rail 5 which tends to be lifted and cams it into its left-hand broken line position (FIG. 4), i.e. to the left, thereby shifting the chain coupled to this rail axial inwardly, i.e. in the direction of the arrow E (FIG. 1) to thereby swing the louvers into their closed position (FIG. 1) automatically and thereby ensure that the louvers will be closed for windup of the shutter even if they have not previously been closed.

Figure 2:
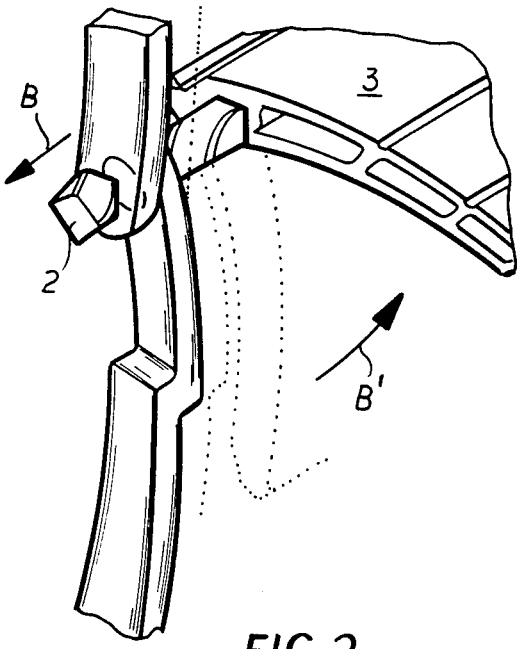
FIG. 2 is a fragmentary perspective view of a portion of a shutter with the single louver shown being in its open position, the closed position of this louver being illustrated by dotted lines.

The louvers and the parts of the chain, rails and profiles illustrated in FIGS. 1 and 2 can be composed of a synthetic resin material or of metal, while the pins are preferably constituted of metal.

Of course when the rail 5 is lowered, the camming inclined plank 14 can engage another formation so as to ensure displacement of the rail to the right to swing the louvers into their open positions (FIG. 2). Both the guide 14 and the ramp 38 can be engaged by the chain links directly so that the chain links can cause shifting of the rail when the roller shutter is raised or lowered.

FIGS. 4–10 illustrate another embodiment of the invention, i.e. a roller shutter in which the control of the pivotal movement of the louvers is so effected that apart from the rotatable movement of the louvers in the manner which has already been described, a translatory movement can be imparted to the louvers so that alternate louvers can be shifted in their longitudinal directions oppositely from one and the other sides.

To this end the louver 3 are movably mounted in their axial directions on the chains 1 of which only one has been illustrated. Each louver, however, is formed along both of its longitudinal edges with wall sections 15 separated by spaces 16 open toward the respective edges. The wall portions of each louver can engage in the spaces between the wall portions of an adjoining louver and can swing into these spaces.

After the wall sections have been so interdigitated, i.e. swung one into a gap between others of the adjoining louver, the two adjoining louvers are translatorily shifted relative to one another so that overlapping of the wall sections of adjoining louvers occurs at least over a portion of the length (in the axial direction) of the interdigitated wall sections. The range of displacement has been represented at D in FIG. 6.

Figure 6:
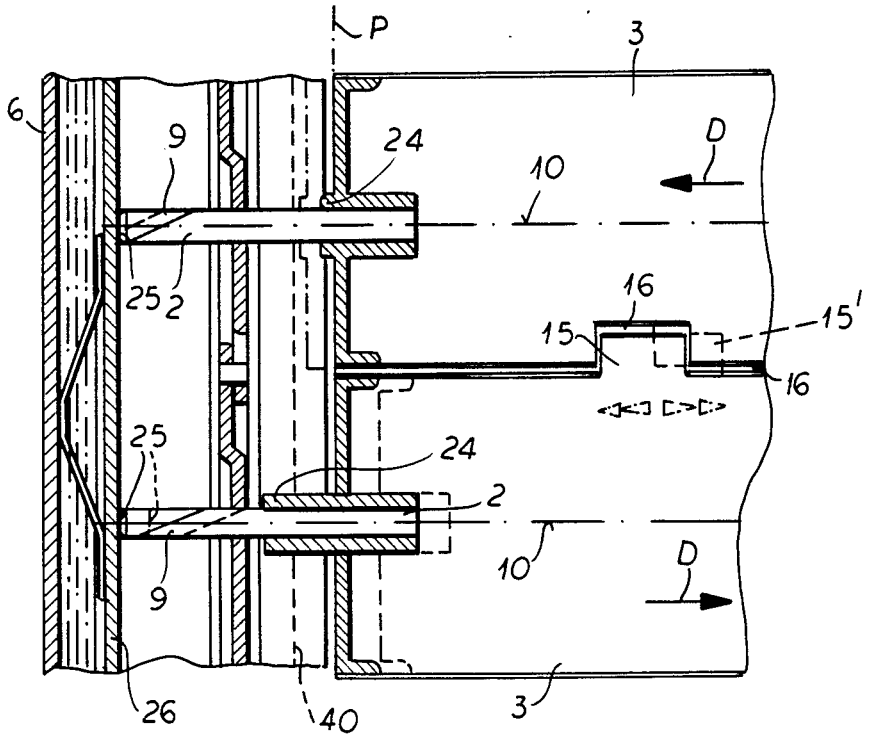
FIG. 6 is a section taken along line VI—VI of FIG. 5 indicating in broken lines the translatory shift of the louvers.

FIG. 6 shows in broken lines the relative positions of the louvers after a shifting operation. Note that the upper louver 3 is thereby shifted to the left, the lower louver 3 is shifted to the right and the two numbered wall portions 15 of the two louvers overlap in the region 15'.

Obviously with such overlap of the wall portions 15, the lateral edges of the louvers which previously lay in a plane P perpendicular to the axes 10 of the pins 2 (perpendicular to the plane of the paper in FIG. 6) but are offset to either side of this plane alternately.

To block any opening along the edges of the shutter array, the displacement rail 5 can be provided with extensions as shown at 40 which can project from the profile 6 and extend over the ends of the louvers including those louvers which have been shifted away from that rail. Obviously a mirror-symmetrical displacement rail likewise covering any gaps along the edges can be provided on the opposite of the shutter.

Figure 5:
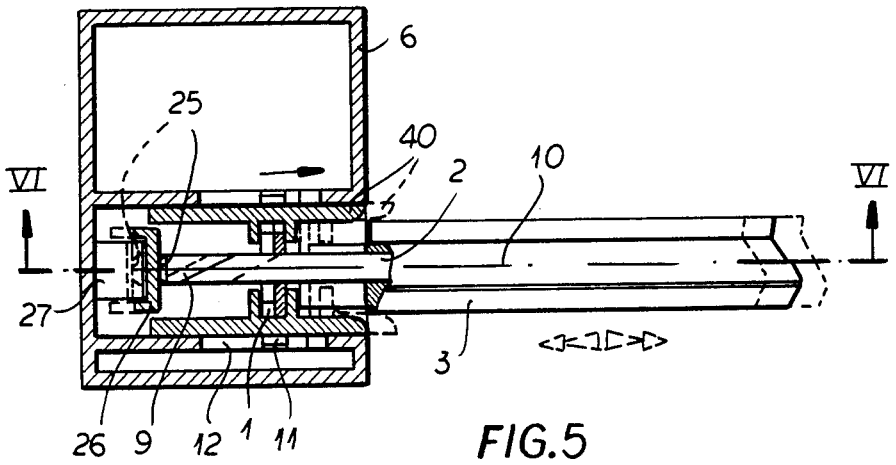
FIG. 5 is a partial horizontal section through a further embodiment of the roller shutter of the invention in which the louvers are not only swingable about the axis of the respective journaling pins 1 but can be moved with respect to the latter in translation.

The position of the rail in which it extends from the profile 6 has been illustrated in broken lines in FIG. 5.

Figure 10:
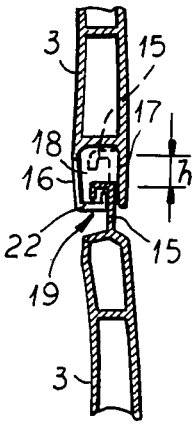
FIG. 10 is a vertical section through two louvers of a shutter according to the invention in closed position whereby the solid lines illustrate the hooked relationship of neighboring louvers and broken lines show the disengaged positions thereof.

To insure obstruction of gaps 16 which may become exposed upon the relative shifting of the louvers in translation, each louver 3 is formed on its lower edge with a continuous apron 17 (see FIG. 10).

The apron 17 is spaced forwardly on the lower wall sections 15 of the respective louver. This can be clearly seen from FIGS. 8 and 10.

In the space 18 between the interdigitatable wall sections 15 and the apron 17 of each louver, therefore, the wall sections of an adjacent louver can be received, as has been clearly indicated in FIG. 10.

The edges of the wall sections 15 extending in the longitudinal direction or in the longitudinal dimension of each louver 3 are formed with hooks 19. The hooks 19 of one louver engage the hooks turned in the opposite direction along the lower edge of adjoining louver as is also apparent from FIGS. 8 and 10 so that, once the adjoining louvers have been relatively axially shifted in the manner previously described, a hooking interengagement results which resists the forces transverse to the shutter.

Figure 9:
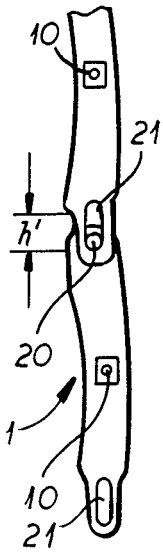
FIG. 9 is a side view showing the interconnection of the links or members of the actuating chain.

FIG. 9 shows the interconnection of the links or members of the chains 1 which are disposed on opposite sides of the shutter of this embodiment. This connection is of the pin-and-slot type represented at 20, 21.

The slots 21 extend substantially in the longitudinal direction of the links or chain elements, i.e. extend linearly in the direction of chain movement. The slots 21 permit a relative displacement of the louvers in the vertical direction, i.e. in a direction perpendicular to the axis of the louvers to permit hooked engagement as shown in FIG. 10 when the shutter is raised somewhat by the cumulative amount of play allowed between the hooks, namely the play h represented in FIG. 8.

In FIG. 9, the axes of the journaling pins 2 have been represented at 10 and the stroke h or play between the louvers has been shown to be at least equal to the excursion h′ permitted the pins in the respective slots 21.

Preferably, the excursion h′ is somewhat greater than the play h permitted between the base 22 of a hook 19 and the free edge 23 of the complementary hook of the other louver.

As a result, with an elevation of the upper member of the shutter by the cumulative play, the interengagement of the hooks of the adjoining shutters is ensured and relative pivotal movement of adjoining shutters induced from the exterior is precluded.

Figure 8:
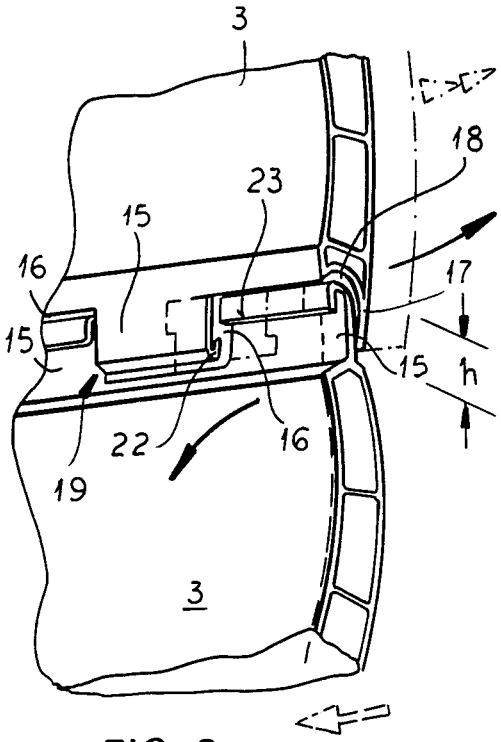
FIG. 8 is a perspective view showing two louvers in closed position prior to effecting a translatory movement and in which in broken lines, the significant parts of the louvers are shown subsequent to the translatory movement.

However, when the shutter is coiled, the chains take up the play and draw the lower hooks into the positions shown in FIG. 8 in which axial displacement can cause them to disengage and the rollup pivoting movement is permitted. Naturally, where opening of the shutters is desired, the chains may be displaced in their length to shift the hooks into their disengaged position shown in FIG. 8 whereupon pivotal movement of the louvers as a result of displacement of the chains parallel to the axes 10 is permitted.

The opening of the louvers in this manner, to permit ventilation, is affected by moving the chains toward one another or apart, i.e. in opposite directions as the case may be to effect the pivotal displacement of the louvers.

To permit the translatory movement of the louvers required for interengagement of the hook-shaped members, it is desirable to provide the journaling pins 2 with regions for no screw formations so that during such translatory movement there will not be an additional angular displacement superimposed upon the louvers.

If the screw formation 9 is a groove in which a pin or other projection of the journal bearing is received in the region at which no angular displacement is desired, the groove can be extended parallel to the axis.

To transfer the translatory movement of the chain links to the louver 3, each louver is formed with a projection or boss 24, preferably constituted as a sleeve receiving the pin 2, from the end face of the respective louver.

The two bearing sleeves 24 at opposite ends of each louver are of different lengths.

In the roller shutter of the invention, the louvers on each side of the shutter have alternating short and long projections as can be seen by a comparison of the projection 24 of the upper louver in FIG. 6 with the projection of the lower louver of this Figure.

The translatory movement of the chain seen in FIG. 6 is thus applied to the lower louver 3 since the links of the chain 1 will just engage the longer projections 24, thereby allowing the lower louver to be shifted to the right and the upper louver to be shifted by the opposite chain (not shown) to the left so that the louvers can assume the positions shown in broken lines.

At the end of the shifting movement, both longer and shorter projections at each side lie against the chains along that side. The end position of the chain 1 is represented in FIG. 6 at 40′. The overlapping of the wall sections 15 resulting from the interdigitation of these wall sections and the relative axial shifting thereof can be seen at the center of FIG. 6.

The end faces 25 of the pins 2 can be seen to be braced against the rails 26 disposed in the profile. The rails 26 are, of course, disposed along both opposite sides of the roller shutter although they are only shown at the left-hand side in FIG. 6.

The rails 26 are biased by leaf springs 27 against the journal pins 2.

Because the actuating rail 24 for the shutters can use the weight of the shutter itself and this can amount to 80 to 100 kg per window, no significant effort need be applied by the user to operate the louver-opening mechanism.

In FIG. 7, three positions of the displacement rail 5 have been shown. The end position with fully lowered roller shutter has been indicated in continuous lines, i.e. solid lines. The weight of the shutter has been transmitted via the closure rail 28 to an entraining element 29 on this rail and via the latter to the rail 5. The closure rail 28 can thus be coupled to the last louver 3 of the roller shutter.

The entrainer 29, as can be seen from FIG. 7, projects laterally beyond the end of the closure rail 28. The shifting rail 5 is formed at its lower end with a pin 30 cooperating with the entrainer 29, which can be a fork, during the latter stage of the lowering movement of the roller blind, the rail 5 lowering correspondingly. Since the entrainer 29 is a fork swingable about the axis 33 and having a bifurcated end receiving the pin 30, it can also have a tooth-like formation 34 which can engage one or another of the detents 36, 37 formed on a spring 35. In this position the rail 28 is so locked to the rail 5 that efforts to penetrate the shutter from the exterior are ineffective.

In broken lines in FIG. 7, I have shown a position of the device in which the rail 28 is offset from the position previously described and in which the fork 31 is about to engage the pin 30. Here the fork is held by the detent 36. With further lowering of the rail 28, the fork is swung into the detent 37. Upon lifting of the shutter, a reverse sequence of movements is effected. Consequently, firstly, the louvers are shifted in translation by the chains 2 until their ends are aligned along opposite edges to the shutter to release the hooks 19 and position the wall sections 15 in the interspaces 16. A further displacement of the chains, of course, can effect a swinging open of the louvers, and of course, with the louvers closed but the hooks released, the shutter can be rolled up.

I claim:

1. A roller shutter comprising:

an array of louvers each formed with bearing-pin members projecting from opposite ends of each louver and defining a pivot axis for the respective louver in a longitudinal direction thereof;

respective chains flanking said louvers and having links receiving said bearing-pin members, each of said bearing-pin member cooperating with a respective journal member, each journal member and the respective bearing-pin member being provided with mating screw formations; and means for shifting at least one of said chains in said direction linearly so as to cause relative movement of the respective journal member and the respective bearing-pin member so as to swing said louvers about the respective axes between open and closed louver positions.

2. The roller shutter defined in claim 1 wherein said means for shifting includes a shifting rail along a side of said shutter receiving said one of said chains, and said shifting rail being displaceable in a respective profile disposed along a corresponding side of said shutter.

3. The roller shutter defined in claim 2 wherein one of said profile and said rail is provided with a plurality of parallel slots inclined to a longitudinal dimension of said rail and to said direction, the other of said profile and said rail having pins engageable in said slots whereby relative displacement of said rail and said profile in the direction of the longitudinal dimension of said rail shifts said rail parallel to said axes.

4. The roller shutter defined in claim 2 wherein said louvers are adapted to be received in a shutter housing, further comprising in the region of an entrance of said housing, an inclined guide on said rail engageable with links of said one of said chains, parallel to a ramp fixed on said housing parallel to said guide.

5. The roller shutter defined in claim 4 wherein said guide and said ramp lie parallel to slots formed on one of said rail and said profile, the other of said rail and said profile having pins engaging in said slots.

6. The roller shutter defined in claim 1 wherein said louvers are relatively shiftable in translation in said direction and adjacent shutters are provided along their confronting longitudinal edges with spaced apart wall sections defining interspaces between them whereby the wall sections of adjoining louvers can be interdigitated so that relative axial displacement of said louvers overlaps interdigitaged wall sections of adjoining louvers.

7. The roller shutter defined in claim 6 wherein said louvers are provided with aprons extending continuosuly ahead of the respective wall sections and shielding said interspaces from access.

8. The roller shutter defined in claim 7 wherein the interdigitated wall sections are provided with hooks mutually engageable with one another.

9. The roller shutter defined in claim 8 wherein said chains are provided with links interconnected in a pin-and-slot connection defining a play between links of said chains at least equal to a play between mutually engageable hooks of adjoining louvers.

10. The roller shutter defined in claim 6 wherein said louvers are formed on opposite ends with projections of different lengths engageable with said chains whereby displacement of said chains in said direction engages said projections to relatively shift said louvers alternately in opposite directions.

11. The roller shutter defined in claim 10, further comprising spring-loaded bars along opposite sides of said rails bearing upon said bearing-pin members in opposite directions.

12. The roller shutter defined in claim 2, further comprising a latching bar connected with a last of said louvers and formed with an entrainer at an end thereof engageable with a pin of said rail for releasably latching said rail to said bar.

13. The roller shutter defined in claim 12 wherein said entrainer is a fork pivotally mounted on said bar engaging said pin of said rail.

14. The roller shutter defined in claim 12 wherein said fork is pivotally mounted on said bar about an axis perpendicular to a plane of said shutter.

15. The roller shutter defined in claim 14 wherein said fork is provided with a tooth-like projection selectively engageable in a pair of detents formed by a leaf spring.

16. A roller shutter, comprising:

an array of louvers each formed with bearing pins projecting from opposite ends of each louver and defining a pivot axis for the respective louver extending in a longitudinal direction thereof;

respective chains flanking said louvers and having links receiving said bearing pins;

respective screwthread formations on at least one bearing pin and a respective link of each of said louvers and a respective one of said chains and so formed that displacement of said one of said chains in a direction parallel to said pivot axes will swing said louvers about said pivot axes between open and closed louver positions; and means for shifting said one of said chains linearly in said direction parallel to said pivot axes.

* * * * *